US005662556A

United States Patent [19]

Gangloff

[11] Patent Number: 5,662,556

[45] Date of Patent: Sep. 2, 1997

[54] PORTABLE EXERCISE BAR DEVICE

[76] Inventor: Robert B. Gangloff, 54 Dorchester St., Huntington Station, N.Y. 11746

[21] Appl. No.: 600,401

[22] Filed: Feb. 12, 1996

Related U.S. Application Data

[60] Continuation-in-part of Ser. No. 337,272, Nov. 10, 1994, Pat. No. 5,527,242, which is a division of Ser. No. 236,349, May 2, 1994, which is a continuation-in-part of Ser. No. 139,538, Oct. 20, 1993, Pat. No. 5,389,055.

[51] Int. Cl.[6] ..... A63B 1/00

[52] U.S. Cl. ..... 482/38; 482/17

[58] Field of Search ..... 482/38, 39, 40, 482/41, 42, 143, 138, 17, 104, 107, 142

[56] References Cited

U.S. PATENT DOCUMENTS

| | | |
|---|---|---|
| 201,328 | 3/1878 | Chamberlin . |
| D. 290,033 | 5/1987 | Policastro . |
| D. 297,957 | 10/1988 | Gordon, III . |
| 829,653 | 11/1906 | Kercher . |
| 838,539 | 12/1906 | Haye . |
| 1,286,151 | 11/1918 | Tothill . |
| 1,410,149 | 3/1922 | Williams et al. . |
| 2,706,631 | 4/1955 | Holmes . |
| 2,932,510 | 4/1960 | Kravitz . |
| 3,642,278 | 2/1972 | Hinckley . |
| 4,126,307 | 11/1978 | Stevenson . |
| 4,201,380 | 5/1980 | Birch . |
| 4,227,688 | 10/1980 | Senoh et al. . |
| 4,286,782 | 9/1981 | Fuhrhop . |
| 4,473,225 | 9/1984 | Miller . |
| 4,696,470 | 9/1987 | Fenner . |
| 4,749,187 | 6/1988 | Dellinger et al. . |
| 4,772,011 | 9/1988 | Guridi . |
| 5,156,580 | 10/1992 | Holland et al. . |
| 5,290,209 | 3/1994 | Wilkinson ..... 482/38 |

FOREIGN PATENT DOCUMENTS

| | | |
|---|---|---|
| 862797 | of 0000 | France . |
| 319819 | of 0000 | Italy . |

*Primary Examiner*—Lynne A. Reichard
*Attorney, Agent, or Firm*—Alfred M. Walker

[57] ABSTRACT

A specially designed foldable exercise apparatus is provided for doing pull-ups or chin-ups while the heels of he feet remain on the floor. It includes a chrome-plated steel base with welded upright frame bar supports extendable upward on each side of the base, with an uninterrupted space provided between the upright frame bar supports for the torso of user's body to be placed therebetween. The vertical supports extend upward with one on each side, approximately midway between a front edge and a rear edge of the base, so that the base extends outward in both directions from the vertical support posts. The pull-up supports are fabricated with apertures or notched vertical supports or hooks on the exterior for placement therein of a horizontal support bar which is movable. The support bar is preferably fabricated of tubular steel with rubber caps on each end to prevent slipping off the support posts. An optional cross brace is provided to stabilize the support posts in place in a vertical position of use. The user lies between the support posts and pulls himself or herself up to the desired level while the heels of the user remain on the floor.

13 Claims, 8 Drawing Sheets

PORTABLE EXERCISE BAR DEVICE

This application is a continuation-in-part of application Ser. No. 08/337,272, filed Nov. 10, 1994, now U.S. Pat. No. 5,527,242 which is a division of application Ser. No. 08/236,349 filed May 2, 1994, which is a continuation-in-part of application Ser. No. 08/139,538, filed Oct. 20, 1993, now U.S. Pat. No. 5,389,055, dated Feb. 14, 1995. This application is also based on Applicant's disclosure document No. 294,258 of Oct. 21, 1991.

FIELD OF THE INVENTION

The present invention relates to an exercise apparatus used for doing modified pull-ups and chin-ups. The apparatus is a foldable apparatus for use in a supine position facing up with the heels on the ground.

The apparatus includes a movable horizontal bar having insertion members which are selectively inserted within corresponding holding means, such as holes or slots, of two parallel upright frame posts.

In one embodiment the insertion members of the horizontal bar include spring loaded movable pins activated by trigger handles on each side so that the user can squeeze the trigger handles to remove the spring loaded movable extension pins which extend into the corresponding holding means, such as holes, for the two upright frame posts.

In a further embodiment the insertion members of the movable horizontal bar includes non-movable extension pins which fit within corresponding holding means, such as slots, within the two upright frame posts.

The upright frame posts are each positioned in a fixed or hinged position, extending upward from a base, permitting the torso of a human body to be positioned therebetween in a supine position. The horizontal top bar is positioned therebetween so that the horizontal bar may be adjusted while the user is lying in a supine position between the fixed or hinged upright frame posts.

To provide stability during use, the upright frame posts are centrally located upon the two outside lateral edges of the base to compensate for the angular pull of a user thereby preventing the tipping over of the device while in use. In the preferred embodiment, a hinged cross brace member is provided at an upper end of the upright frame posts to stabilize the vertical upright posts in a vertical position of use.

The apparatus can be folded down for easy carrying. The horizontal chin-up/pull-up bar is dismantled from the upright frame posts and placed along the plane of the flat base. The two hinged upright frame posts swivel down from the vertical to a horizontal position upon the flat base for easy storage and carrying of the apparatus.

BACKGROUND OF THE INVENTION

Various exercise devices include a height adjustment feature for horizontal bars, which are attached to vertical walls or associated structures.

The prior art includes exercising or sport equipment for conducting pull-ups and chin-ups, or horizontal bars for gymnastics and ballet.

Included among the prior art patents are:

| U.S. Pat. Nos. | |
|---|---|
| 201,328 | of Chamberlin |
| 290,033 | of Policastro |
| 297,957 | of Gordon |
| 829,653 | of Kercher |
| 838,539 | of Haye |
| 1,286,151 | of Tothill |
| 1,410,149 | of Williams et al. |
| 2,706,631 | of Holmes |
| 2,932,510 | of Kravitz |
| 3,642,278 | of Hinckley |
| 4,126,307 | of Stevenson |
| 4,201,380 | of Birch |
| 4,227,688 | of Senoh et al. |
| 4,286,782 | of Fuhrop |
| 4,473,225 | of Miller |
| 4,696,470 | of Fenner |
| 4,749,187 | of Dellinger |
| 4,772,011 | of Guridi |
| 5,516,580 | of Holland et al. |

Among foreign patents include France Patent No. 862,797 of Etienne and Italian Patent No. 319,819 of Crespi.

Of the relevant prior art, U.S. Pat. No. 2,932,510 of Kravitz concerns a portable ballet bar. Design Patent No. 290,033 of Policastro concerns an exercise bar apparatus and Design Patent No. 297,957 of Gordon, III concerns a chin-up bar.

U.S. Pat. No. 201,328 of Chamberlin concern a gymnastic leaping apparatus including two notched uprights and a vertical bar above a raised base.

U.S. Pat. No. 829,653 of Kercher discloses a portable horizontal bar insertable within castings attached to a door frame.

U.S. Pat. No. 838,539 of Haye relates to an amusement device. The apparatus has a horizontal bar supported by a frame and an upright. An appropriate means may be employed for the vertical adjustment of the horizontal bar.

U.S. Pat. No. 1,286,151 of Tothill discloses a horizontal bar used on playgrounds and athletic fields. The bar is secured to the uprights by a locking device, which is made of a flat piece bent upon itself to form an eye at its upper end. The lower end is bent to provide two parallel spaced-apart portions to receive a pin.

U.S. Pat. No. 1,410,149 of Williams et al. describes a horizontal bar having frame members to support the bar. The frame members may be folded to release the bar. The apparatus can also be easily stored or packed.

U.S. Pat. No. 3,642,278 of Hinckley relates to a chinning bar apparatus having a bar adjustably attached to a vertical structural member. U-shaped bolts are used to adjust the height of the bar.

U.S. Pat. No. 4,126,307 of Stevenson describes a portable ballet bar. The bar comprises a handrail supported by a pair of adjustable legs. Each leg has a bracing member to secure the bar in a certain position.

U.S. Pat. No. 4,201,380 of Birch discloses a portable disassemblable stand for weight lifting equipment.

U.S. Pat. No. 4,4473,225 of Miller discloses a doorway mounted horizontal bar.

U.S. Pat. No. 4,227,688 of Senoh et al. describes an exercise bar comprising a grip rod supported by uprights having chains or cables for anchoring the hooks for supporting the structure.

U.S. Pat. No. 4,286,782 of Fuhrop discloses a multi-purpose exercise apparatus having an adjustable horizontal member. The apparatus is easily collapsible and readily storable.

U.S. Pat. No. 5,156,580 of Holland et al. describes a therapeutic traction apparatus for enabling a person to apply gentle traction to the human spine by suspending the entire body vertically by the arms while supporting some of the weight through the legs. The apparatus includes an adjustable hanging bar and support members. The support members are secured to a spreader bar by triangular panel members.

U.S. Pat. No. 4,772,011 of Guridi is for an exercise apparatus installable within a door way. The device is not self standing, and Guridi '011 requires a door jamb as its main structure. It is not adjustable from a position of use. Because it must be installed in a door jamb, the device of Guridi '011 is unsafe and inconvenient for users.

Moreover, changing the height of the horizontal bar in Guridi '011 requires the complex task of unscrewing, removing, and relocating and screwing again the threaded holding knobs.

U.S. Pat. No. 4,696,470 of Fenner describes a dancer's barre structure with a horizontal rail held by the dancer while practicing dance exercise. However, the Fenner '470 structure includes two upright frame posts located at the extreme edge of a base, rather than at a central location along the lateral edges, which creates an unstable mechanism unless the user's weight is kept to the base side of the structure.

Also, folding down of the Fenner '470 structure takes up much space, since the hinging is done in the direction of the edge of the base, as opposed to folding towards the middle surface of the base. As a result, for portability purposes, the lateral size of the Fenner structure base must be as large as the size of the vertical upright posts.

Moreover, Fenner cannot be adjusted by the user while in use, since adjusting the height of Fenner '470 structure is cumbersome, as it requires unscrewing and screwing of each of tightened wing nuts into respective holding means, such as holes, of the upright frame posts.

In addition, the horizontal bar of Fenner is not removable, but is permanently attached to an upper portion of the upright frame posts.

U.S. Pat. No. 2,706,631 of Holmes and U.S. Pat. No. 4,749,187 of Dellinger describe track and field hurdles which are height adjustable. However, both devices are by nature designed to tip over and fall down when struck by a hurdler, in the direction away from the base legs. Therefore, neither Holmes '631 or Dellinger '187 teach a device which can be pulled from below while remaining stable upon the ground.

Moreover, neither the Holmes '631 and Dellinger '187 are designed to fold down for portability, as the vertical upright posts are "L" shaped, with permanent horizontal base leg portions attached to the upright frame posts.

In Dellinger '187, movement of the horizontal bar requires also moving downwardly extending vertical supports which are permanently attached to the horizontal bar. In addition, the cumbersome latch mechanism for moving the latch pins on each downward extension into appropriate holding means, such as holes, in the upright frame posts includes a handle below the horizontal bar which cannot be gripped by the fingers of a user holding the horizontal bar from below.

Furthermore, the spring loaded handles of Holmes '631 are adjacent to each other below and in the vicinity of the horizontal bar, so changing the position cannot be accomplished without moving the palms of the user's hands away from the horizontal bar.

Furthermore, as in Dellinger '187, the handles are also below the horizontal bar, so they cannot be manipulated by the user's fingers while holding the horizontal bar from below.

Moreover, none of the allegedly portable devices of Fenner '470, Dellinger '187 or Holmes '631 can be used by a user lying in a supine position above a base and below a horizontal bar, because all three devices of Fenner '470, Dellinger '187 and Holmes '631 include structural impediments between the horizontal bar above a user and the base below the user.

For example, the hurdles of both Holmes '631 and Dellinger '187 include lower horizontal structural cross posts which interrupt the space between the upper horizontal bar and the base, thus preventing a user from lying supine therebetween.

Furthermore, Holmes also includes a second cross bar below the horizontal bar.

Fenner '470 includes inwardly and upwardly extending angled support brackets, which partially interrupt the space between the horizontal bar and the base, also preventing the user from lying supine therebetween.

Furthermore, the Dellinger '187 device is not readily adjustable from the position of use, as it is evident that vertical adjustment is spring loaded to the main frame, and it requires opposing loads and balanced forces at both ends to prevent binding of the vertical members.

In addition, the Dellinger '187 and Holmes '631 hurdles need to be adjusted by the user while standing up, thereby teaching away from the adjustment of the bar during use. For example, Holmes '631 describes adjusting the hurdle by retracting the pins with one hand and raising the horizontal bar with the other hand.

OBJECTS OF THE INVENTION

It is an object of the present invention to provide a chin-up/pull-up apparatus which can be folded down to a substantially two dimensional device, for easy carrying.

It is a further object to provide an exercise apparatus which can be dismantled from the upright frame posts and placed along the plane of the flat base.

It is yet a further object to provide an exercise apparatus wherein the two hinged upright frame posts swivel down from the vertical position of use to a horizontal position upon the flat base for easy storage and carrying of the apparatus.

It is yet a further object of the present invention to provide a apparatus which enables the user to custom fit the desirable position of the horizontal bar while the user is already in the supine, facing up position upon the floor.

It is yet a further object of the present invention to provide hinged, upright frame posts which swivel down conveniently to a horizontal position at rest.

It is yet another object to provide an exercise apparatus which includes a horizontal bar which can be moved vertically while the user is in a supine position below the horizontal bar.

It is a further object to provide an exercise apparatus with a horizontal bar which can be adjusted in height while being held in the palm of the hands of a user.

It is yet another object to provide an exercise apparatus with trigger handles above a horizontal bar, so that a user can manipulate the handles with the user's fingers, while the user holds the bar in the palms of the hands of the user.

It is yet another object to provide a stable exercise device which will not tip over while in use.

It is also an object of the present invention to make it easy and safe to use a portable exercise machine.

It is a further object of the present invention to provide a portable exercise device with two uprights, which device allows the user to raise both uprights simultaneously with one hand while using the other hand to move the uprights into a usable position.

It is yet another object to improve over the disadvantages of the prior art.

SUMMARY OF THE INVENTION

In keeping with these objects and others which may become apparent, unlike the prior art, the apparatus of the present invention includes a horizontal bar which can be adjusted while in the palm of the hand of the user, while the user is in a supine position, facing up, with the heels on the ground.

The apparatus can be folded down to a substantially two dimensional device, for easy carrying, when the horizontal chin up/pull up bar is dismantled from the upright frame posts and placed along the plane of the flat base.

Thereafter, the two hinged upright frame posts swivel down from the vertical position of use to a horizontal position upon the flat base for easy storage and carrying of the apparatus.

Unlike these prior art devices, such as the ballet bar assembly of U.S. Pat. No. 2,932,510 of Kravitz, or the hurdles of Holmes '631 or Dellinger '187, wherein the horizontal bar is moved and tightened before or after exercise from a standing position, the present invention enables the user to custom fit the desirable position of the horizontal bar while the user is already in the supine, facing up position upon the floor.

Moreover, as compared to Kravitz '510, the hinged, upright frame posts of the present invention swivel down conveniently to a horizontal position at rest.

As noted, the present invention is an exercise apparatus used for doing pull-ups/chin-ups. The apparatus is a foldable apparatus for use in a supine position facing up with the heels on the ground. It includes a movable horizontal bar which is selectively inserted within corresponding holding means, such as holes, of two parallel upright frame posts. The horizontal bar contains a pair of upwardly extending trigger handles to remove spring loaded extension pins which extend into the corresponding holding means, such as holes, for the two upright frame posts.

In another embodiment, conventional pins can be used to hold the bar in place.

The apparatus can be folded down for easy carrying, unlike the Guridi '011 door jamb structure. The horizontal chin-up/pull-up bar is dismantled from the upright frame posts and placed along the plane of the flat base. The two hinged upright frame posts swivel down from the vertical to a horizontal position upon the flat base for easy storage and carrying of the apparatus.

The device is also stable for use from below. Since a user doing pull-ups or chin-ups from a supine position pulls down at an angle toward the chin of the user, it is essential that the device not tip over, as the hurdles of Dellinger '187 or Holmes '631 are designed to tip over and fall down when struck by the hurdler. Even the ballet barre structure of Fenner '470 can be tipped over if the user does not stand on the base, since in Dellinger, Fenner and Holmes the upright frame posts supporting the horizontal bar are loaded at an edge of the base.

In contrast, the upright frame posts of the present invention are located centrally along the edges of the base, so that the base extends in both directions away from the upright frame posts. As a result, the force of the user's body pulling upon the horizontal bar will not cause the device of the present invention to tip over and fall down.

A further embodiment makes it easier and safer to use the exercise machine. An X-shaped folding arm brace allows the user to raise both uprights simultaneously with one hand while using the other hand to facilitate the position of a connecting brace bar, made of the two joined leg members. The X-shaped folding arm brace moves into a usable locking horizontal position, wherein both leg members are joined by a fastener and rest coaxially in the horizontal locking position. When the locking position is achieved, a clip on the longer leg member of the X-shaped folding arm brace fits over the corresponding shorter leg member, providing a straight firm tie across the top of the vertically positioned upright frame posts.

Thus, the vertically positioned upright frame posts are braced against falling and are also held at the proper distance for the horizontal crossbar to be easily positioned without any chance of falling between the two upright frame posts.

The X-shaped folding arm brace is made with the one shorter leg member being slightly longer than half of the span between the upright frame posts, and the other longer leg member extends approximately the length of the horizontal span between the vertical upright frame posts.

The leg members of the X-shaped folding arm brace are joined at one half the distance of the span between the vertical upright frame posts, with a pivot point fastener loose enough to allow the two leg members to be rotated in relation to each other.

Furthermore, the leg members of the X-shaped folding arm brace are provided with similar pivot points, such as pins, at each end, whereby they can be attached to the top of the hinged upright frame posts of the exercise device, when the upright frame posts are in the vertical position of use.

The longer leg member of the X-shaped folding arm brace is provided with a fastener, such as a U-shaped clip fastener, in such a way as to allow the U-shaped clip fastener to engage and fit over the shorter leg member when the leg members are in the horizontal locking position.

To return the leg members to the folded-down position of non-use, the longer leg member is raised until the crossover rotation point of the leg members is reached, at which time a directional shift of pressure in the raised upright frame posts causes a crossover of the upright frame posts.

A lowering motion of the leg members of the X-shaped folding arm brace allows the two upright frame posts to go into the folded-down position, with the X-shaped folding arm brace folding down in between the two upright frame posts as well.

DESCRIPTION OF THE DRAWINGS

Other objects of the present invention will become apparent from the description and the drawings of the present invention, in which.

DETAILED DESCRIPTION OF THE PREFERRED EMBODIMENT

Figure 1:
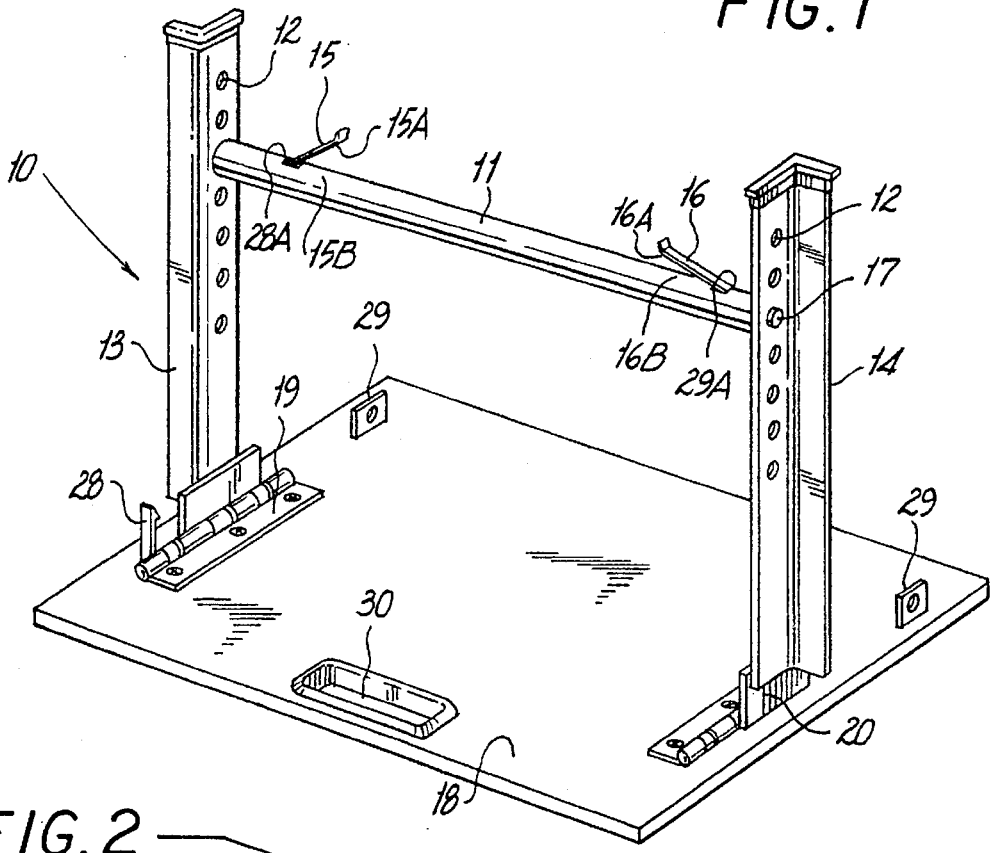
FIG. 1 is an overall perspective view of the assembled preferred embodiment of the apparatus.

As shown in FIGS. 1–3 and 7–9, the present invention includes an exercise apparatus 10 used for doing pull-ups/chin-ups. Apparatus 10 is a foldable apparatus for use in a supine position facing up with the heels on the ground. It includes movable horizontal bar 11 which is selectively inserted within corresponding holding means, such as holes 12 of parallel upright frame posts 13 and 14.

Upright frame posts 13, 14 extend upward in respective predetermined positions from horizontal base 18 for permitting the torso of a user to be placed therebetween, and horizontal bar 11 is positioned therebetween a height above base 18 to permit the torso of the user to extend uninterrupted between horizontal bar 11 and base 18.

Moreover, for stability, upright frame posts 13, 14 extend up from base 18 along each lateral edge of base 18, at approximately midpoint between the center of base 18 to provide stability and prevent base 18 from tipping over while the user pulls horizontal bar 11 down at an angle toward to user's chin. While it is preferable to be centrally located, posts 13, 14 may be placed from ¼ to ¾ along the lateral edges of base 18, so that base 18 extends significantly out in both directions away from upright frame posts 13, 14.

It is also contemplated that while the drawing figures show base 18 to be rectangular, other geometric shapes may be provided, such as a square, an oval, a polygon or a circle, as long as there is sufficient distance for upright frame posts 13, 14 to be separated from each other to accommodate the torso of the user in a supine position therebetween. In that case, upright frame posts 13, 14 are generally near a peripheral edge thereof at the widest part thereof, such as the diameter of a circle or the widest diameter of an oval, as well being also centrally located along the peripheral edge between a front and a rear of the base.

For further stability, upright frame posts 13, 14 may be moved up from a flat horizontal position of non-use from base 18, but such movement is restricted by contact of the bottom of upright frame posts 13, 14 upon the surface of base 18.

In the movable pin embodiment shown in FIGS. 1–3 and 6–9, horizontal bar 11 contains a pair of trigger handles 15 and 16 to remove spring loaded extension pins 17, which pins 17 extend into corresponding holding means, such as holes 12, for upright frame posts 13 and 14. Trigger handles 15, 16 extend upward from horizontal bar 11 near the ends thereof, so that the user can pull down upon trigger handles 13, 14 with the user's fingers while holding horizontal bar 11 in the palms of the user's hand. Alternatively, conventional pins can be used.

Apparatus 10 can be folded down for easy carrying. Horizontal chin-up/pull-up bar 11 is dismantled from upright frame posts 13 and 14 and placed along the horizontal plane of flat base 18. Base 18 is optionally portable or attachable to a floor. Upright frame posts 13 and 14 are affixed and attached to hinges 19 and 20, and swivel down from a vertical to a horizontal position upon base 18 for easy storage and carrying of apparatus 10. After upright frame posts 13 and 14 are folded down to base 18, upright frame posts 13 and 14 are held secured in place by means of locking tabs 28 extending up from base 18 in the vicinity of hinges 19 and 20.

Apparatus 10 is a specially designed exercise apparatus used for doing pull-ups or chin-ups from a semi-supine position wherein the torso of the user is elevated from horizontal bar 11 while the heels of the user are on the floor.

Although any suitable materials may be used, preferably, apparatus 10 is fabricated with steel or steel alloy. Apparatus 10 includes chrome-plated or baked enamel steel base 18 measuring approximately 12 inches by 36 inches with upright frame posts 13 and 14 on each side of base 18.

Vertical support posts 13 and 14 preferably measure approximately 34 inches high, with one bar on each side.

Figure 4:
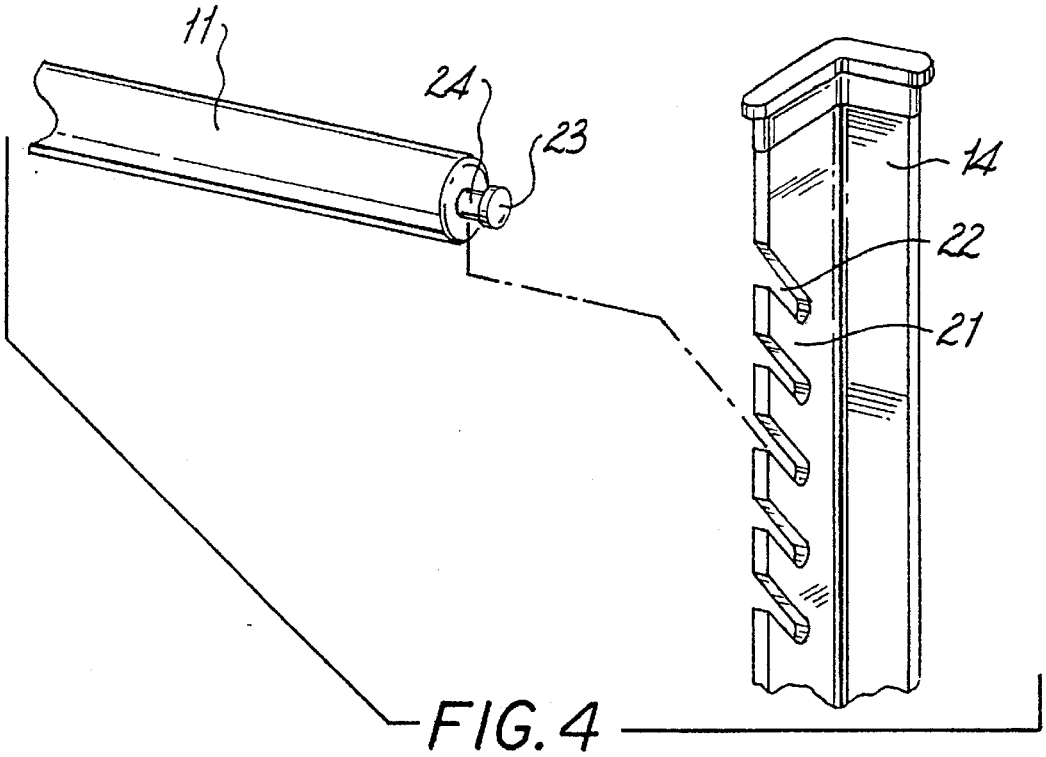
FIG. 4 is a local perspective view of alternate leg embodiment having oblong slots to accept non-movable pins on a chin-up bar.

In the alternative embodiment shown in FIG. 4, vertical support posts 13 and 14 may be fabricated with notched vertical support hooks 21 with notches 22 on upright frame posts 13 and 14 for placement of horizontal support bar 11 therein.

Horizontal support bar 11 may also be fabricated of tubular steel measuring approximately 30 to 40 inches long and one to one and one-half inches in diameter with caps 23, such as rubber or steel heads, and end rod members 24 on each end to prevent slipping off of horizontal support bar 11 from within notches 22.

In use, the user lies between vertical support posts 13 and 14 and pulls the upper body of himself or herself up to the desired level.

In particular, FIG. 1 shows an overall perspective view of the assembled preferred embodiment of portable, foldable exercise apparatus 10.

Figure 2:
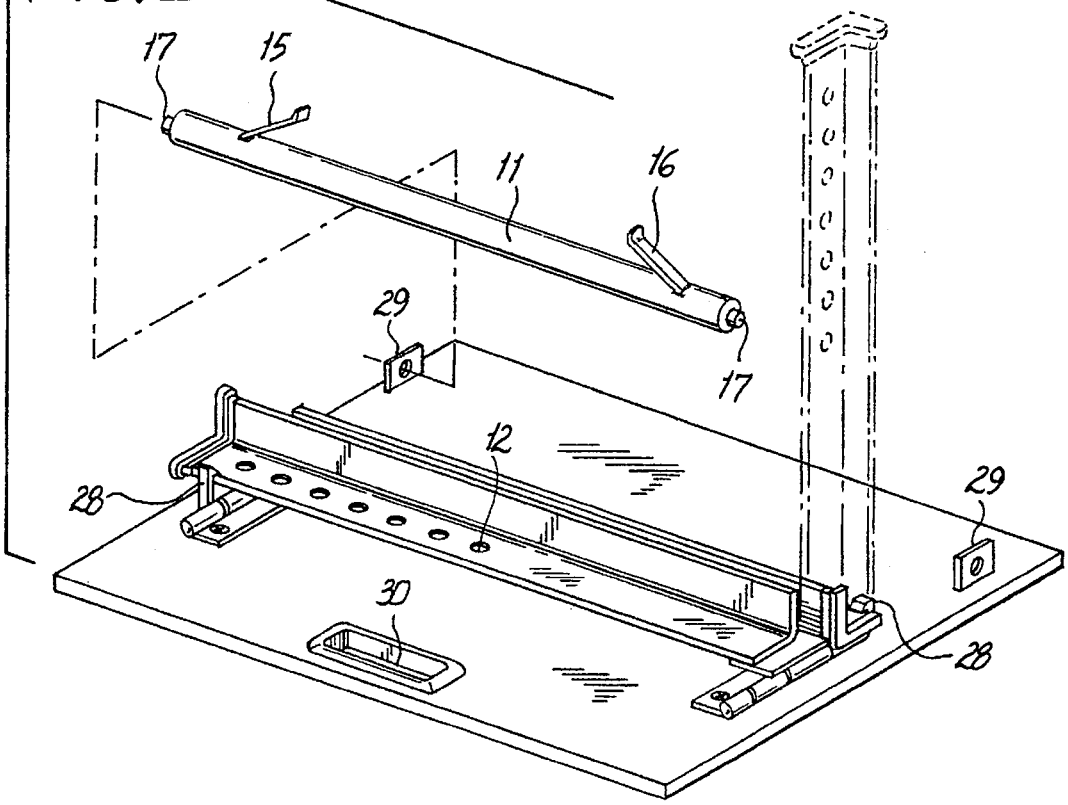
FIG. 2 is an overall perspective of the preferred embodiment with legs collapsed down for storage, and chinning bar exploded from storage securement tabs.

FIG. 2 shows the preferred embodiment of apparatus 10 with vertical frame posts 13 and 14 collapsed down for storage. FIG. 2 also reveals spring-loaded pins 17 for attachment of horizontal bar 11 to upright vertical frame posts 13 and 14.

Figure 3:
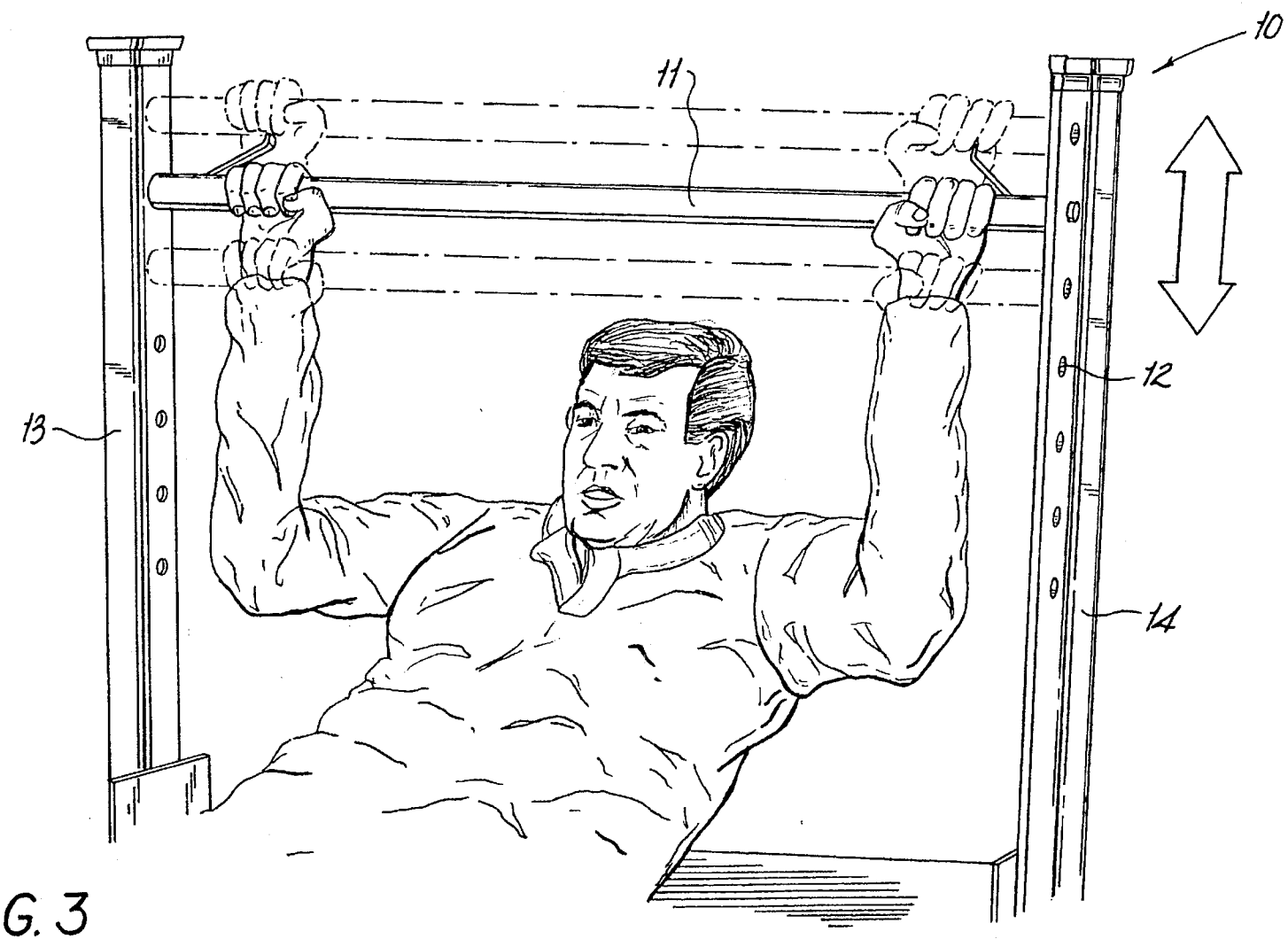
FIG. 3 is a perspective view of preferred embodiment illustrating adjustability of chin-up bar by user while exercising.

FIG. 3 illustrates the adjustability of chin-up bar by user while exercising.

In the movable pin embodiment as shown in FIGS. 1–3 and 6–9, the appropriate means for the vertical adjustment of horizontal bar 11 includes trigger-release type handles 15 and 16 for adjusting horizontal bar 11 while the user is in the supine position facing up. For the vertical adjustment of horizontal bar 11, horizontal bar 11 includes oppositely positioned side end pin portions 17, which are insertable into respective hole 12 within each of vertical frame posts 13 and 14.

Horizontal bar 11 may be inserted into upright frame posts 13 and 14 by means of conventional pins, which pins are insertable within corresponding holes 12 located within vertical frame posts 13 and 14. Holes 12 correspond to various vertical placement locations for horizontal bar 11 along the inside vertical surfaces of upright frame posts 13 and 14.

While horizontal bar 11 may be inserted into upright frame posts 13 and 14 by means of conventional pins insertable within the corresponding holes 12 located within vertical frame posts 13 and 14, horizontal bar 11 preferably contains finger operable trigger handles 15 and 16 on each side of horizontal bar 11, so that the user can squeeze trigger handles 15 and 16 with the fingers from above, to remove spring loaded extension pins 17, which extend into corresponding holding means, such as holes 12 of upright frame posts 13 and 14, while holding horizontal bar 11 with the palms of the hands of the user.

Spring loaded extension pins 17 of handles 15, 16 include outer projection 17A connected to body portion 17B, which is further connected at an opposite end thereof to inner projection connector 17C. Inner projection connector 17C includes movement restriction knob 17D, which movement restriction knob 17D holds inner projection connector 17C within respective grooves 15C, 16C of respective base portions 15B, 16B of respective trigger handle 15,16.

Extension pins 17 of handles 15, 16 rest in a closed position within apertures 12 of upright frame bar 13. Pins 17 are urged within aperture 12 by means of springs 17F, which springs 17F urge filler plugs 17E against movement restriction knobs 17D of pins 17, thereby urging pins 17 within apertures 12 of upright frame posts 13, 14 during stable use of horizontal bar 11 by the user while performing chin-ups or pull-ups from a supine position.

To release pins 17 from their locked position within apertures 12 of upright frame posts 13,14, and thereby free horizontal bar 11 for vertical adjustment, trigger handles 15, 16 include manually operable trigger portions 15A and 16A of finger operable trigger handles 15 and 16. Each of trigger handles 15 and 16 also include respective base lever portions 15B and 16B connected to respective handle portions 15A, 16A. Respective base lever portions 15B, 16B are insertable within upper holding means, such as slots, 11A, 11A' and lower holding means, such as slots, 11B, 11B' respectively within horizontal bar 11. Manual downward pulling of trigger portions 15A and 16A urges base lever portions 15B and 16B against fulcrum points 28A and 29A, which fulcrum points 28A, 29A are located on the edge of lower holding means, such as slots, 11B, 11B' closest to upright frame posts 13 and 14 respectively. Base lever portions 15B and 16B are respectively rotatable about fulcrums 28A and 29A.

Each respective extension pin 17 is releasable from each respective aperture 12 in which it is inserted, upon the manual exertion of finger pressure upon trigger portions 15A and 16A, while the user holds horizontal bar 11 within the palms of the hands of the user. Consequently extension pins 17 are connected to respective trigger portion 15A or 16A by inner connection members 17C, so that extension pins 17 may move away from respective apertures 12, whereby the user can squeeze trigger handle 15 or 16 to remove respective spring loaded extension pin 17 from corresponding apertures 12 within upright frame posts 13,14.

Each extension pin 17 is insertable into respective corresponding aperture 12 of upright frame bar 13 or 14 upon release of finger operable trigger portion 15A or 16A, and the subsequent movement of extension pins 17 into apertures 12 within upright frame posts 13, 14.

Thus downward compression of trigger handle portions 15A, 16A toward horizontal bar 11 causes retraction of exterior pins 17 from corresponding apertures 12 within upright frame posts 13, 14, thus allowing horizontal bar 11 to be moved to a desired vertical position between posts 13, 14. Vertical movement of horizontal bar 11 can be accomplished by the user from a supine position.

The user can lie supine upon the base in the uninterrupted space between each vertical frame bar 13 and 14, and adjust the height of horizontal bar 11 according to the desired height for the user.

Moreover, because trigger handles 15, 16 are above horizontal bar 11, handles 15, 16 can be compressed down by the user's fingers while the user holds the bar 11 within the palms of the hands of the user.

Upright frame posts 13 and 14 are secured to base 18 by preferable hinged panel members 19 and 20. After use of apparatus 10 by the user, upright vertical frame posts 13 and 14 may be folded down from a vertical position to a horizontal position, to rest upright frame posts 13 and 14 flat against the horizontal plane of base 18, so that apparatus 10 can be easily stored or carried by a conventional handle or slot 30.

Apparatus 10 may be used as a therapeutic traction apparatus for enabling a person to apply gentle traction to the human spine by suspending the torso and head of the body by the arms while supporting some of the weight through the heels of the legs on the floor.

Therefore, apparatus 10 provides partial traction while the user lies supine on his or her back with the heels touching the ground, from a supine position, facing up with the heels of the user on the ground. The upper part of the body of the user may be gently pulled up or down in chin up or pullup movements by holding horizontal bar 11, which is selectively inserted within corresponding holding means, such as holes 12 of two parallel upright frame posts 13 and 14.

Consequently, the user does not have to pull the entire body weight off of the ground in an undesirable hanging position which puts undue stress upon the neck, trapezius and deltoid muscles of the user.

In summary, the present invention provides exercise apparatus 10 used for doing modified pull-ups and chin-ups. Apparatus 10 is designed for use by a user in a supine position facing up with the heels of the user on the ground. Extension pins 17 of movable horizontal bar 11 are conveniently selectively inserted within respective aperture holding means, such as holes 12 of parallel upright frame posts 13 and 14 while the user is in a supine position.

In order to avoid unnecessary changing of positions, the user can adjust the position of horizontal bar 11 from a supine position, by using in the preferred embodiment, the pair of trigger handles 15 and 16, which handles 15, 16 are located on each side of horizontal bar 11, so that the user can squeeze trigger handles 15 and 16 without moving the position of the hands away from horizontal bar 11, to release spring loaded extension pins 17, which extend into the corresponding aperture holding means, such as holes 12 within upright frame posts 13 and 14.

While it is preferable to have extension pins 17 on both ends of horizontal bar 11, it is anticipated that a cantilvered version may be used, wherein at least one extension pin is insertable within at least one aperture of at least one upright frame bar 13 or 14.

In the non-movable pin embodiment shown in FIG. 4, upright frame posts 13, 14 include holding means, such as oblong slots 22, to accept non-movable extension end rods 24 on horizontal chin-up bar 11.

To insure that horizontal chin-up bar 11 remains stable in place between upright frame posts 13, 14 in the embodiment shown in FIG. 4, handle chin-up bar 11 may have a first cross sectional diameter greater than a second cross sectional diameter of extension end rods 24. A further pair of extension pins 23, such as caps, extend from end rods 24 at outer ends thereof. Extension pins 23 have a third cross sectional diameter greater than the second diameter of extension end rods 24, to prevent extension end rods 24 from falling out of respective holding means, such as slots, 22 of upright frame members 13, 14.

Figure 5:
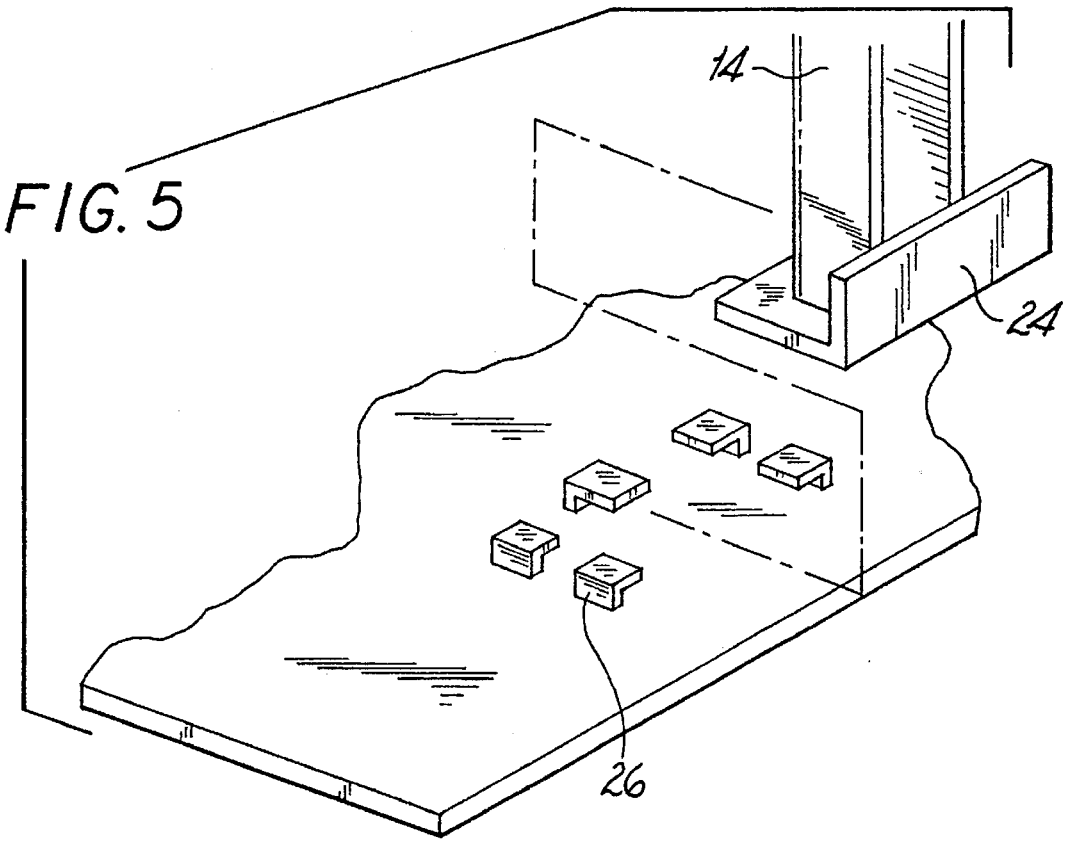
FIG. 5 is a local perspective view of alternate, unhinged leg securement means utilizing a leg plate sliding under bent tabs.
Figure 7:
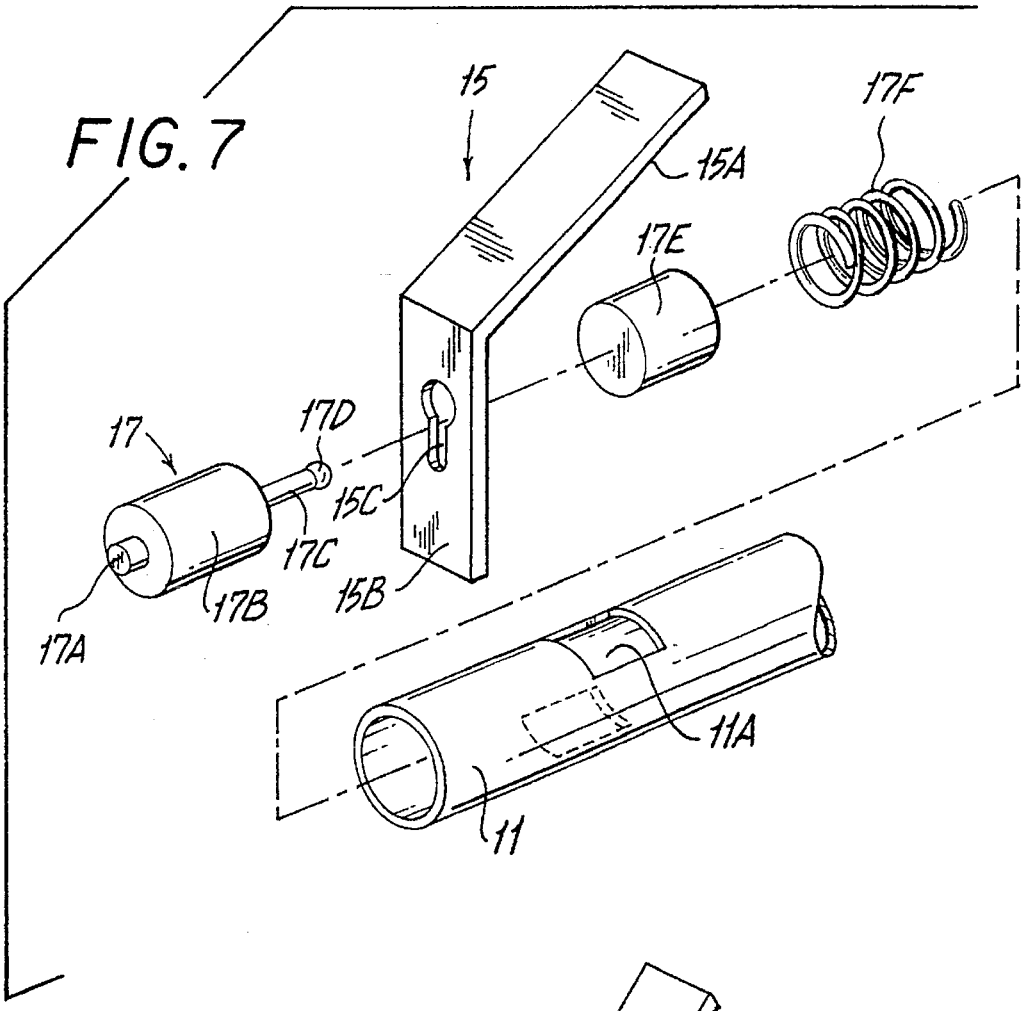
FIG. 7 is an exploded perspective view of the parts shown in FIG. 6.
Figure 6:
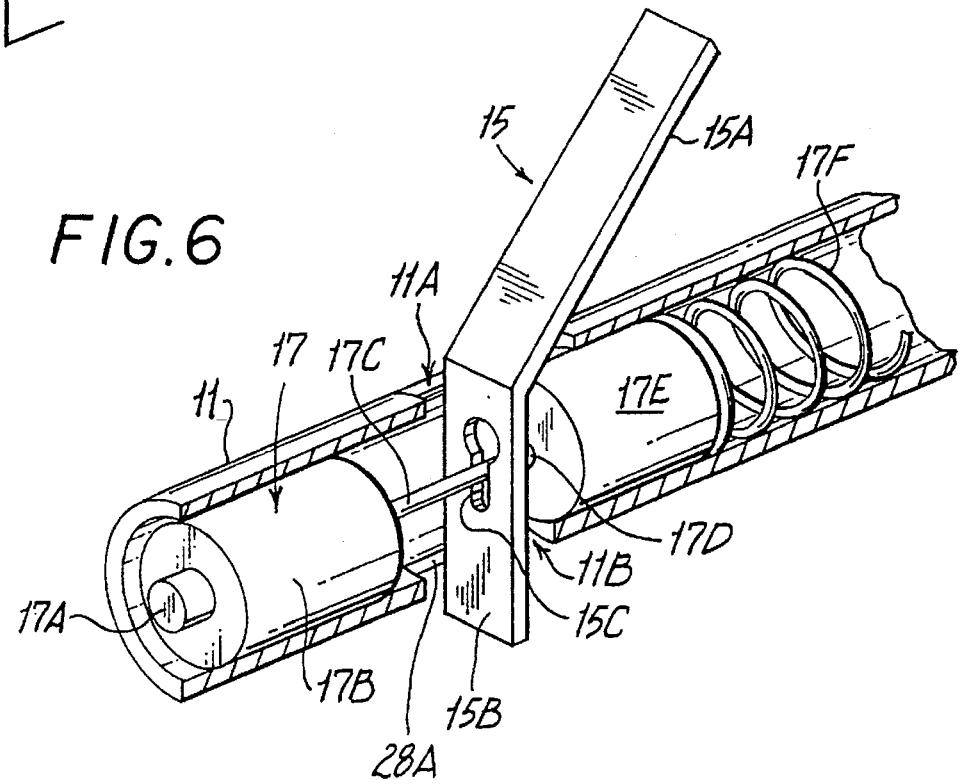
FIG. 6 is a close up perspective view in partial section of the left side adjustment handle portion of the device.
Figure 9:
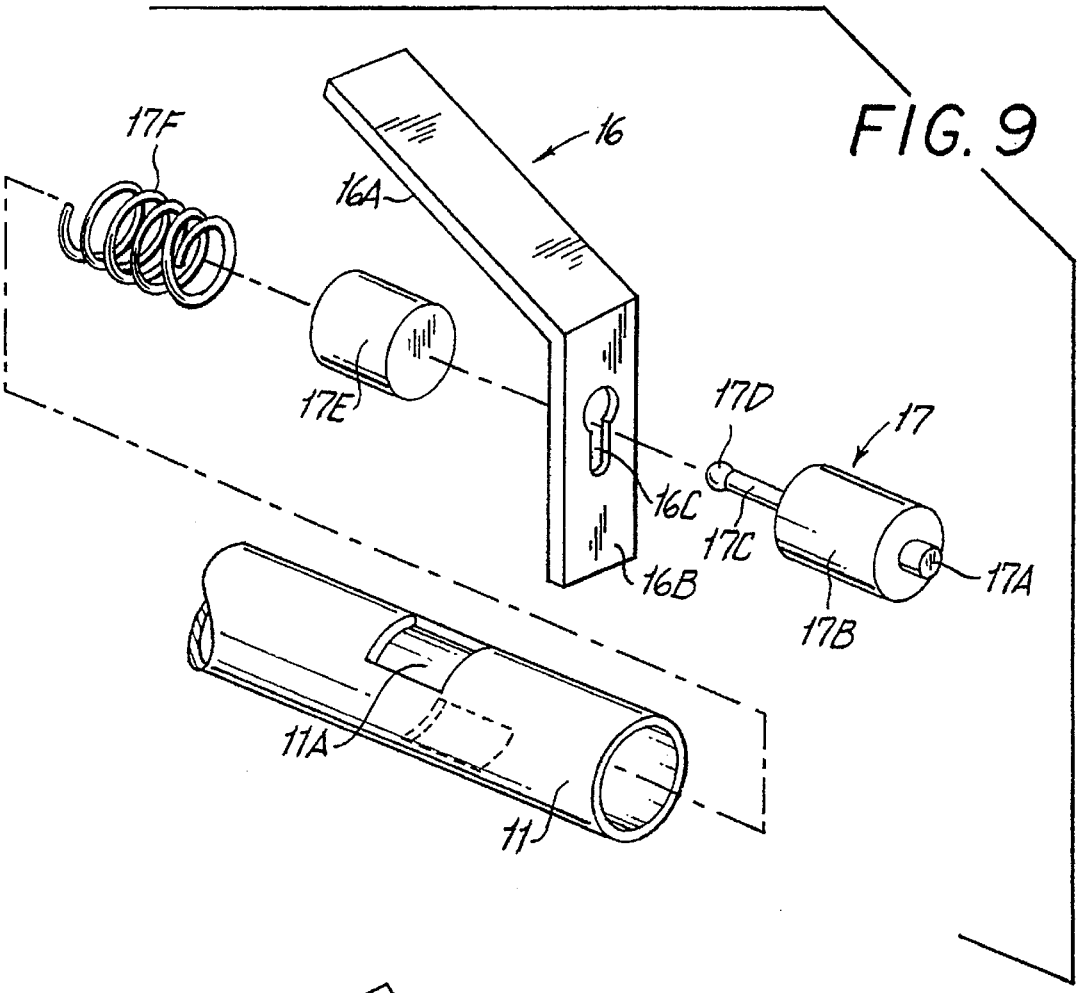
FIG. 9 is an exploded perspective view of the parts shown in FIG. 8.
Figure 8:
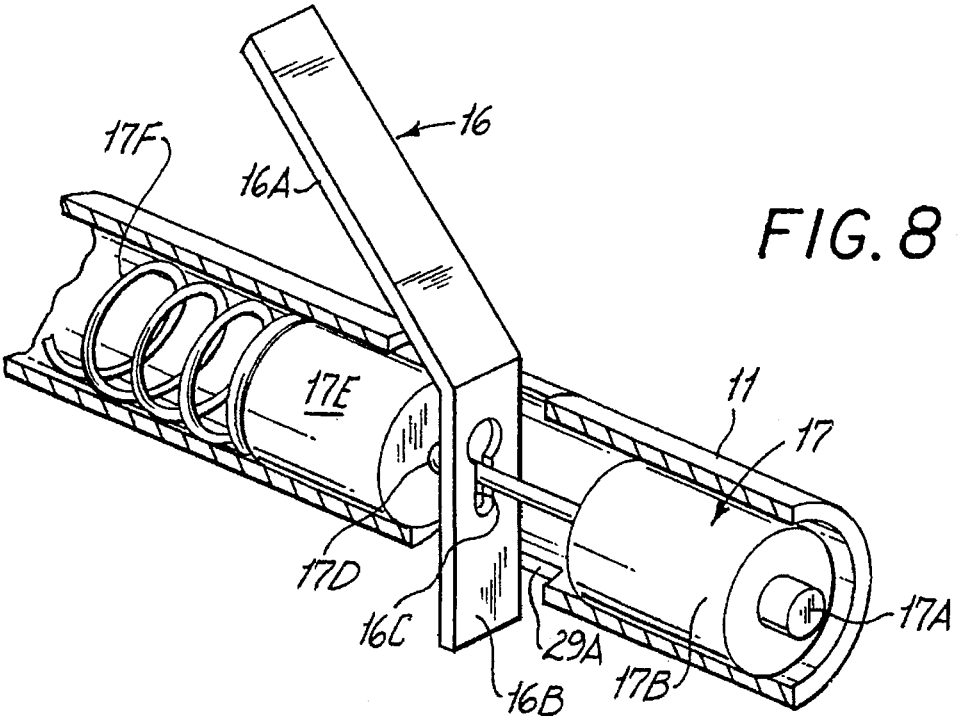
FIG. 8 is a close up perspective view in partial section of the right side adjustment handle portion of the device.
Figure 10:
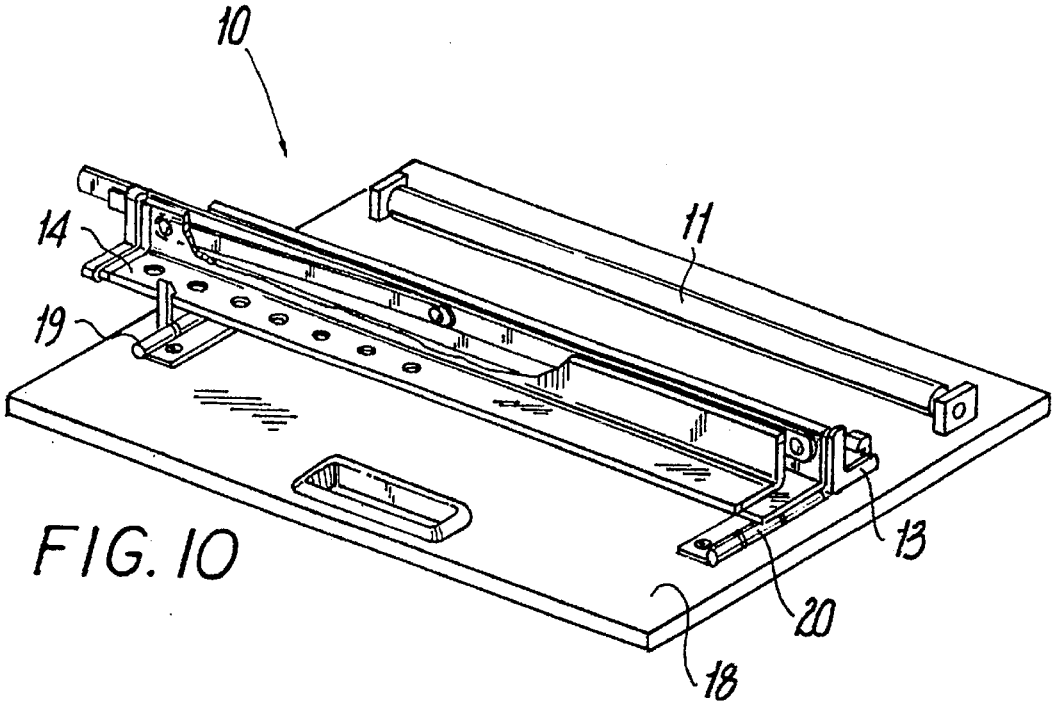
FIG. 10 is a perspective view of another embodiment for the portable exercise device of the present invention with a foldable cross brace, shown in a folded down position.
Figure 11:
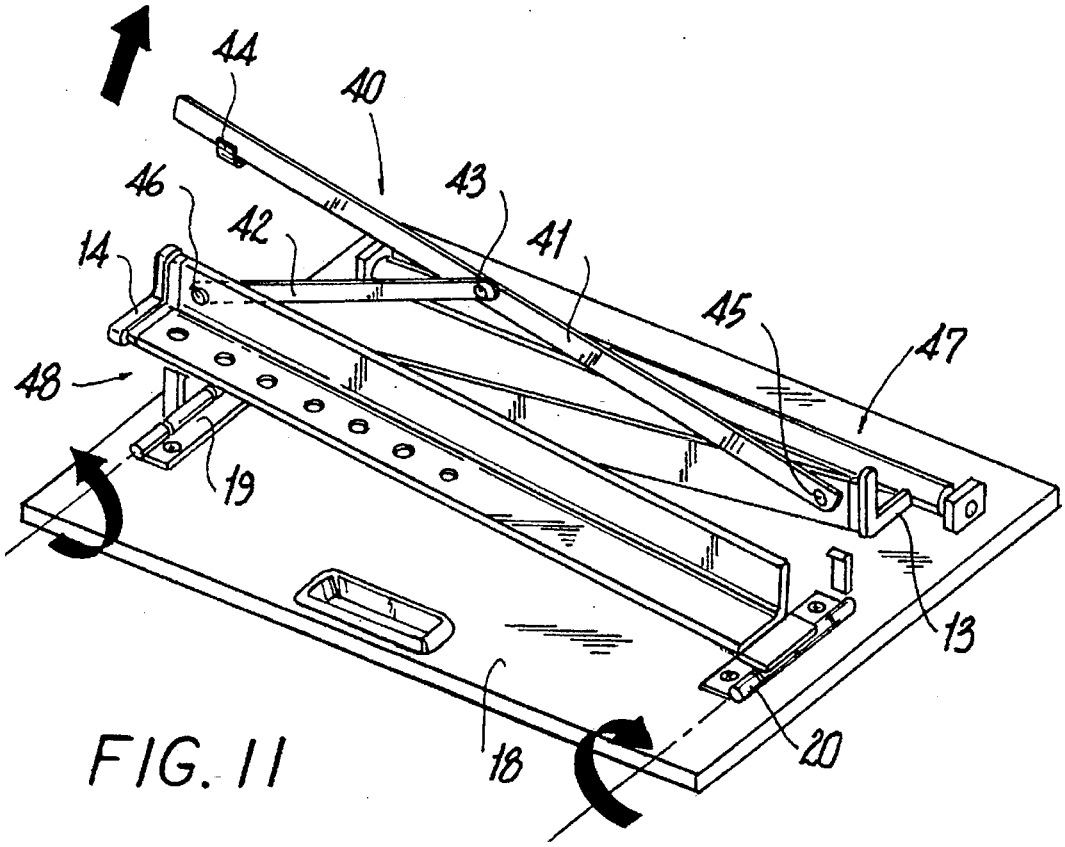
FIG. 11 is a perspective view of the embodiment as in FIG. 10, shown in a partially opened position.
Figure 12:
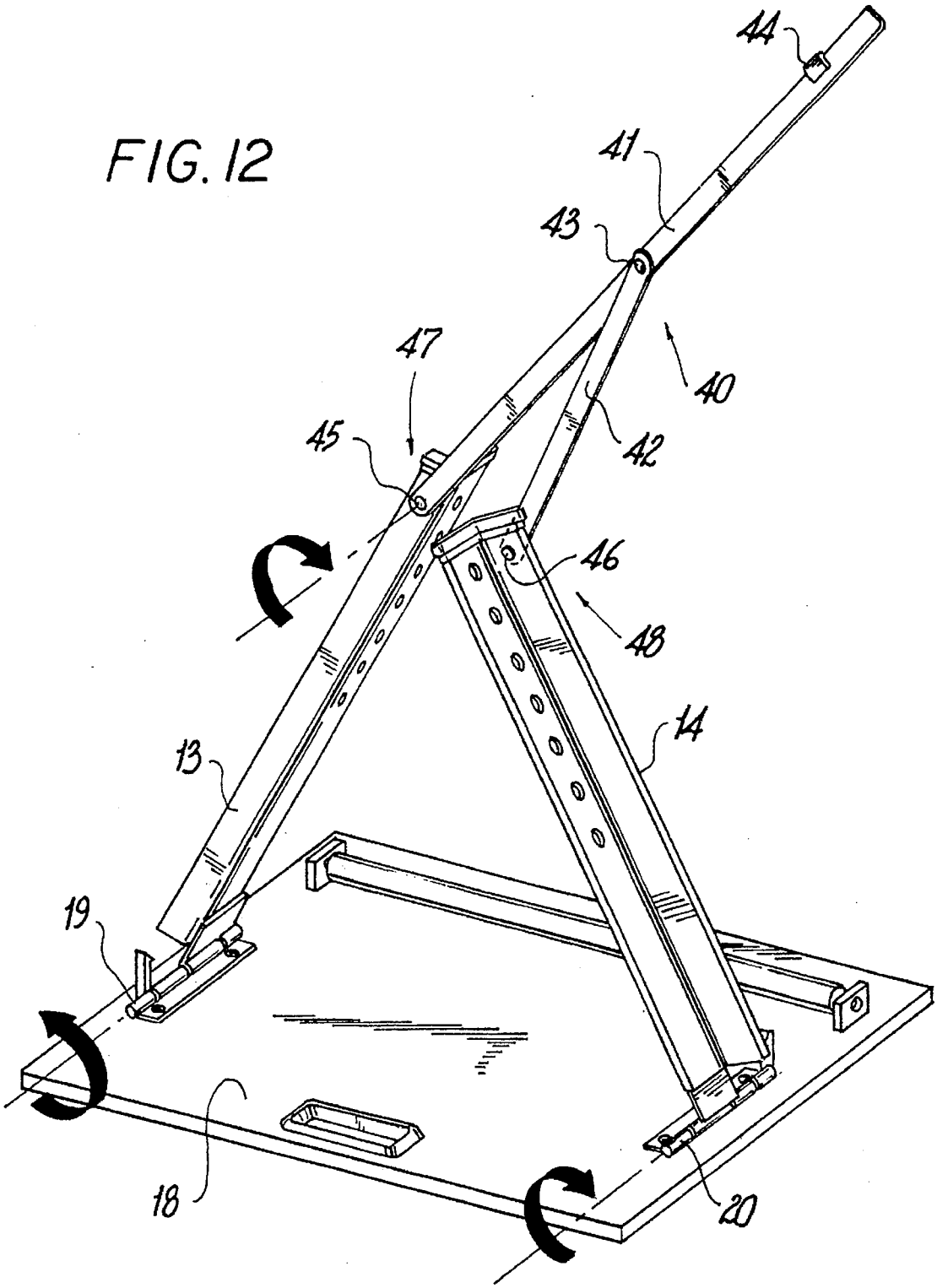
FIG. 12 is a perspective view of the embodiment as in FIG. 10, shown in a further partially opened position.
Figure 13:
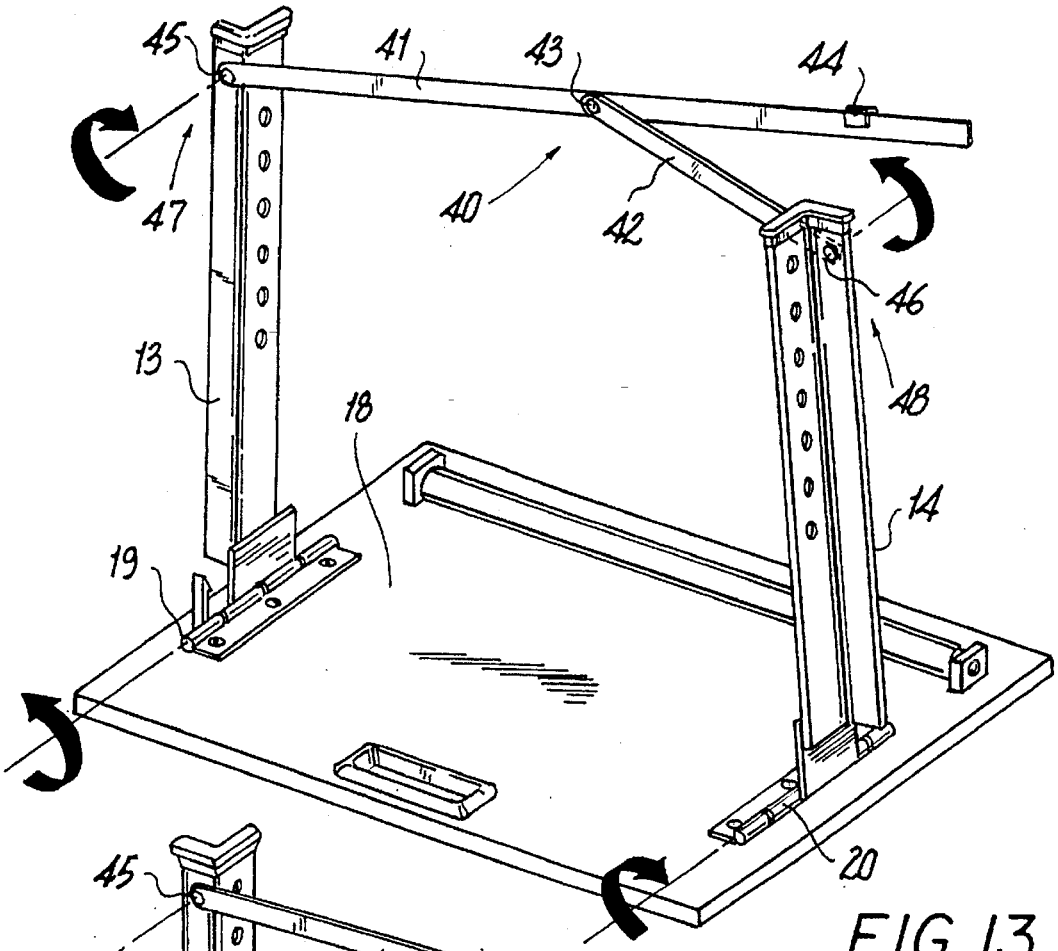
FIG. 13 is a perspective view of the embodiment as in FIG. 10, shown in yet a further advanced partially opened position; and, FIG. 14 is a perspective view of the embodiment as in FIG. 10, shown in an upright position of use.

FIG. 5 shows an alternate, unhinged leg securement means utilizing a leg plate 25 sliding under bent tabs 26.

After use, apparatus 10 can be conveniently folded down for easy carrying. Horizontal chin-up/pull-up bar 11 is dismantled from upright frame posts 13 and 14 and placed along the plane of flat base 18. Upright frame posts 13 and 14 swivel down toward each other in a direction transverse to each lateral edge of base 18, and lock from the vertical to a horizontal position upon base 18 for easy storage and carrying of apparatus 10.

As shown in FIGS. 10–14, a further embodiment makes it easier and safer to use the exercise apparatus 10. To stabilize upright frame posts 13, 14 in a vertical position of use, a cross brace member includes a hinged cross brace member 41 hingeably connected at one end thereof to one upright frame member 13 and removably engagable with another upright frame member 14.

Figure 14:
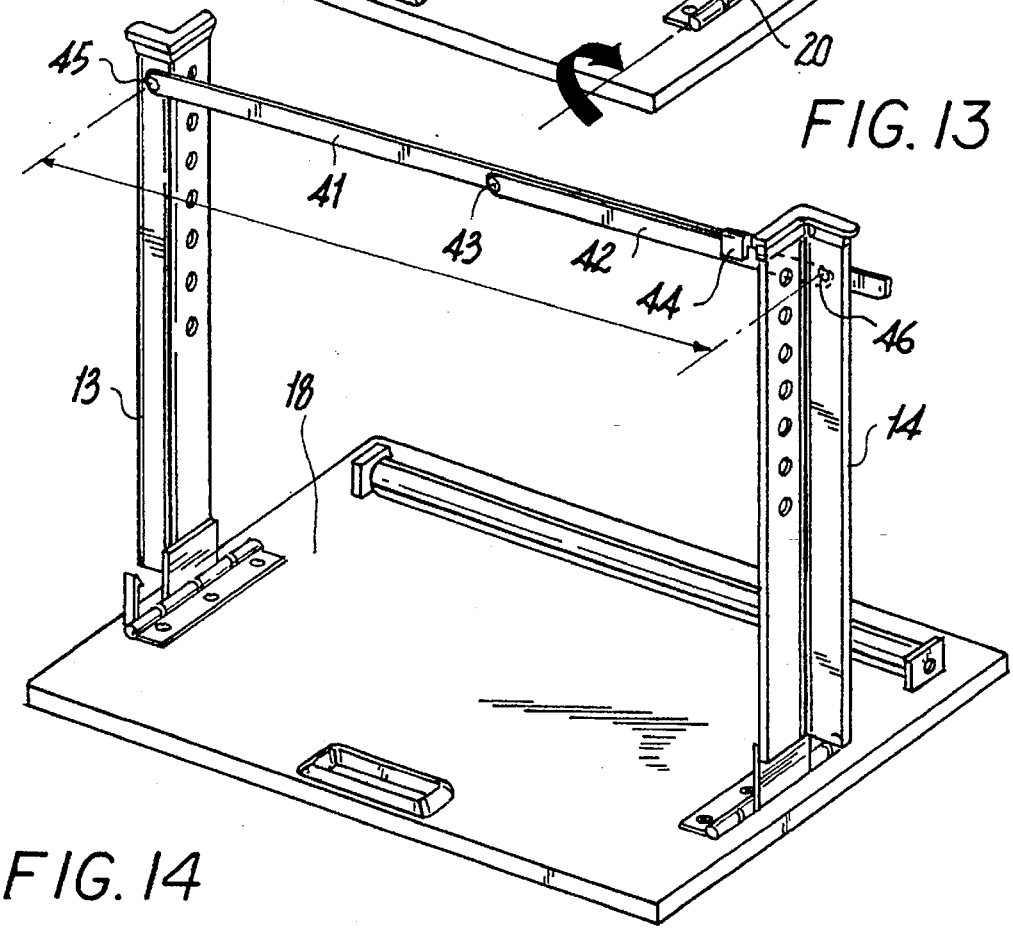

Although such a cross brace can include a single brace member, preferably the cross brace member includes X-shaped folding arm brace 40, which X-shaped folding arm brace 40 allows the user to raise both upright frame posts 13, 14 simultaneously with one hand while using the other hand to position connecting brace bar 40 in place. Connecting brace bar 40 includes two joined leg members 41, 42. X-shaped folding arm brace 40 moves into a usable locking horizontal position shown in FIG. 14, wherein both leg members 41, 42 are Joined by pivot fastener 43 coaxially in the horizontal locking position. When the locking position shown in FIG. 14 is achieved, a further fastener 44, such as a clip, located on longer leg member 41 of X-shaped folding arm brace 40 fits over corresponding shorter leg member 42, thereby providing a straight firm tie across the top of vertically positioned upright frame posts 13, 14.

Therefore, vertically positioned upright frame members 13, 14 are braced against falling and also held apart at a proper distance for horizontal chin-up crossbar 11 to be easily positioned in place therebetween, without any chance of horizontal chin-up crossbar 11 falling between upright frame members 13, 14.

X-shaped folding arm brace 40 is made with shorter leg member 42 being slightly longer than half of the span "S" between upright frame members 13, 14, and other longer leg member 41 being approximately the length of horizontal span "S" extending between vertical upright frame members 13, 14.

Both leg members 41, 42 of X-shaped folding arm brace 40 are joined at one half the distance of the span "S" between vertical upright frame members 13, 14, with pivot point fastener 43 being loose enough to allow leg members 41, 42 to be rotated in relation to each other.

Furthermore, leg members 41, 42 of X-shaped folding arm brace 40 are provided with similar end pivot points 45, 46 at each distal end thereof, whereby leg members 41, 42 are attached to top regions 47, 48 of hinged upright frame posts 13, 14 of exercise device 10, when upright frame posts 13, 14 are in the vertical position of use.

Longer leg member 41 of X-shaped folding arm brace 40 is provided with further fastener 44, such as a U-shaped clip, in such a way as to allow further fastener 44 to engage with and fit over shorter leg member 42 when leg members 41, 42 are in the horizontal locking position.

To return upright posts 13, 14 and leg members 41, 42 to the folded-down position of non-use, longer leg member 41 is raised until the crossover rotation point at pivot fastener 43 of leg members 41, 42 is reached, at which time a directional shift of pressure in raised upright posts 13, 14 causes a crossover of upright posts 13, 14.

A lowering motion of leg members 41, 42 of X-shaped folding arm brace 40 allows upright posts 13, 14 to go into the folded-down position, with X-shaped folding arm brace 40 folding down in between upright posts 13, 14 as well.

In FIGS. 10–14, upright frame posts 13, 14 are shown with holding means, such as holes 12 therein for insertion of horizontal chin-up bar 11 therein.

However, as shown in FIG. 4, alternatively it is contemplated that upright frame posts 13, 14 may also be modified with holding means, such as slots 22, and horizontal chin-up bar 11 may also be modified with extension pins 23 extending from extension rods 24, which extension rods 24 extend from both opposite ends of horizontal chin-up bar 11. In this embodiment shown in FIG. 4, horizontal chin-up bar 11 bears a first cross sectional diameter greater than a second cross sectional diameter of extension end rods 24. Further extension pins 23 extend from end rods 24 at outer ends thereof. In the embodiment shown in FIG. 4, extension pins 23 have a third cross sectional diameter greater than the second diameter of extension end rods 24, to prevent extension end rods 24 from falling out of respective holding means, such as slots, 22 of upright posts 13, 14.

Therefore, X-shaped folding arm brace 40 enables a user to easily and safely raise and lock upright posts 13, 14 into a stable position of use, wherein a user does pull-up or chin-up exercises in a supine position with the heels on the floor.

It is further noted that various other modifications may be made to the present invention without departing from the spirit and scope of the present invention, as noted in the appended claims.

I claim:

1. An exercise apparatus for allowing a user to perform at least one of a pull-up exercise and a chin-up exercise while lying supine on the user's back with the user's heel touching the ground, the apparatus comprising:

a base having a front edge and a rear edge;

a movable horizontal bar, having a pair of ends;

a pair of substantially parallel upright frame posts removably connected to and extending in a substantially vertically direction from said base;

each of said upright frame posts having a plurality of holding means located at a plurality of vertically spaced positions above said base, said holding means corresponding to a plurality of vertical height locations for said movable horizontal bar above said base;

each of said upright posts positioned along a peripheral edge approximately midway between said front and said rear edge of said base;

said horizontal bar including a handle portion and a pair of insertion members at opposite ends thereof;

said insertion members of said horizontal bar being selectively insertable within a pair of respective holding means of said pair of upright posts at one of said plurality of vertical height locations above said base, and, a cross brace connecting said upright frame members, wherein said cross brace member comprises a hinged cross brace member hingeably connected at one end thereof to one of said upright frame posts and removably engagable with another of said upright frame posts.

2. The exercise apparatus as in claim 1 wherein said cross brace member comprises an X-shaped folding arm brace allowing a user to raise said upright frame posts simultaneously with one hand while using the other hand to position said cross brace member in place, said cross brace member including two joined leg members joined by a pivot fastener;

said two joined leg members alignable coaxially in a horizontal locking position; and a further fastener being located on a longer leg member of said two leg members of said X-shaped folding arm brace, said fastener engagable with a shorter leg member of said two leg members, thereby providing a straight firm tie across a top region of said upright frame posts in the vertical position of use.

3. The exercise apparatus as in claim 2 wherein said shorter leg member is slightly longer than half of a span extending between said upright frame members in an upright vertical position of use, and said longer leg member is approximately the length of the span extending between said upright frame members in a vertical position of use.

4. The exercise apparatus as in claim 2 wherein said leg members of said X-shaped folding arm brace are joined at one half the distance of the span between said upright frame members by a pivot point fastener, said pivot point fastener being loose enough to allow said leg members to be rotated in relation to each other.

5. The exercise apparatus as in claim 2 wherein said leg members of said X-shaped folding arm brace are provided with similar end pivot points at each distal end thereof, whereby said leg members are attached by said end pivot points to said top regions of said upright frame posts, when said upright frame posts are in a vertical position of use.

6. The exercise apparatus as in claim 5 wherein said longer leg member of said X-shaped folding arm brace is provided with a further fastener engagable with said shorter leg member when said leg members are in the horizontal locking position.

7. The exercise apparatus as in claim 5 wherein said longer leg member is liftable until a crossover rotation point at said pivot fastener joining said leg members is reached, at which time a directional shift of pressure in said lifted upright posts causes a crossover of said upright posts.

8. The exercise apparatus as in claim 7 wherein said leg members are descendible in a lowering motion thereby moving said upright frame posts to a folded-down position, with said X-shaped folding arm brace folding down in between said upright frame posts.

9. The exercise apparatus as in claim 1 wherein said holding means within said upright frame members are holes.

10. The exercise apparatus as in claim 9 wherein said insertion members are movable and are insertable within said holes of said upright frame posts.

11. The exercise apparatus as in claim 1 wherein said holding means within said upright frame posts are slots.

12. The exercise apparatus as in claim 11 wherein said insertion members are immovable and are insertable within said slots of said upright frame posts.

13. The exercise apparatus as in claim 12 wherein said insertion members comprise extension pins extending from extension rods, which said extension rods extend from opposite ends of said movable horizontal bar, and wherein said movable horizontal bar has a first cross sectional diameter greater than a second cross sectional diameter of said extension rods, and wherein said extension pins extend from said end rods at outer ends thereof, said extension pins having a third cross sectional diameter greater than the second diameter of said extension rods, to prevent said extension rods from falling out of respective slots of said upright frame posts.

* * * * *